US007313894B2

(12) United States Patent
Mise et al.

(10) Patent No.: US 7,313,894 B2
(45) Date of Patent: Jan. 1, 2008

(54) PACKAGING AND PRICING DEVICE

(75) Inventors: Youichi Mise, Tokyo (JP); Nobue Iwakura, Tokyo (JP)

(73) Assignee: Teraoka Seiko Co., Ltd., Tokyo (JP)

( * ) Notice: Subject to any disclaimer, the term of this patent is extended or adjusted under 35 U.S.C. 154(b) by 0 days.

(21) Appl. No.: 11/068,745

(22) Filed: Mar. 2, 2005

(65) Prior Publication Data

US 2005/0193684 A1 Sep. 8, 2005

(30) Foreign Application Priority Data

Mar. 5, 2004 (JP) ..... 2004-062317
Aug. 31, 2004 (JP) ..... 2004-252173

(51) Int. Cl.
*B65B 57/02* (2006.01)
*B65B 11/00* (2006.01)

(52) U.S. Cl. ..... 53/64; 53/209; 53/136.3; 53/415; 156/DIG. 2; 156/DIG. 37; 156/560

(58) Field of Classification Search ..... 53/64, 53/136.1, 209, 441, 461, 556; 156/DIG. 2, 156/DIG. 3, DIG. 40, 64, 360, 560
See application file for complete search history.

(56) References Cited

U.S. PATENT DOCUMENTS 4,458,470 A * 7/1984 Fine ..... 53/502
4,543,766 A * 10/1985 Boshinski ..... 53/64
4,561,921 A * 12/1985 Treiber ..... 156/297
4,615,757 A * 10/1986 Treiber ..... 156/350
4,857,121 A * 8/1989 Markley et al. ..... 156/64
5,078,816 A * 1/1992 Ratermann ..... 156/64
5,205,104 A * 4/1993 Nakashima et al. ..... 53/64
6,895,728 B2 * 5/2005 Kondo ..... 53/441

FOREIGN PATENT DOCUMENTS

| | | |
|---|---|---|
| EP | 0456999 | 11/1991 |
| JP | 2000-016413 | 1/2000 |
| JP | 2000-296822 | 10/2000 |
| JP | 2001-097544 | 4/2001 |

OTHER PUBLICATIONS

English language abstract of JP 2001-097544.
English language abstract of JP 2000-016413.
English Language Abstract of JP 2000-296822.

* cited by examiner

*Primary Examiner*—Thanh K. Truong
(74) *Attorney, Agent, or Firm*—Greenblum & Bernstein, P.L.C.

(57) ABSTRACT

A packaging and pricing device for sticking labels on a packaged substance including a first label issuing unit and a second label issuing unit, arranged at both sides around the packaging unit, for issuing labels having different display contents. There is a first applicator and a second applicator for sticking the labels issued from the first labeling issuing unit and the second label issuing unit to a predetermined position on the packaged substance, respectively. The first applicator has a first driving mechanism configured to move the first applicator horizontally between the first label issuing unit and a corresponding sticking position, and the second applicator has a second driving mechanism configured to move the second applicator horizontally between the second label issuing unit and a corresponding sticking position. Additionally, the first applicator and the second applicator perform the sticking operations so as not to interfere with each other.

6 Claims, 9 Drawing Sheets

*Fig. 7*

PRODUCT FILE

| PLU No. | PRODUCT NAME | UNIT PRICE | BARCODE | EXPIRATION DATE | INDIVIDUAL IDENTIFICATION NUMBER | IMAGE | LABEL ISSUING UNIT No.1 | LABEL ISSUING UNIT No.2 | INTERLOCK / NONINTERLOCK |
|---|---|---|---|---|---|---|---|---|---|
| 0001 | AAAA | 250 | OOOOO | 2004.8.1 | | 1 | 1 | 1 | |
| | | | | | | | | | |
| | | | | | | | | | |
| | | | | | | | | | |

D

*Fig. 8A*

INDIVIDUAL IDENTIFICATION NUMBER FILE

| No. | INDIVIDUAL IDENTIFICATION NUMBER |
|---|---|
| 1 | 1234567890 |
| 2 | 2345678901 |
| 3 | • |
| • | • |
| • | • |

*Fig. 8B*

IMAGE FILE

| No. | IMAGE |
|---|---|
| 1 | SALE |
| 2 | BARGAIN |
| 3 | • |
| • | • |
| • | • |

*Fig. 8C*

LABEL FORMAT FOR LABEL ISSUING UNIT No.1

| No. | FORMAT NAME |
|---|---|
| 1 | T1 |
| 2 | T2 |
| 3 | T3 |
| • | • |
| • | • |

*Fig. 8D*

LABEL FORMAT FOR LABEL ISSUING UNIT No.2

| No. | FORMAT NAME |
|---|---|
| 1 | T50 |
| 2 | T51 |
| 3 | T52 |
| • | • |
| • | • |

LABEL FORMAT

| No. | FORMAT NAME | LABEL ISSUING UNIT No.1 | LABEL ISSUING UNIT No.2 |
|---|---|---|---|
| 1 | T80 | 0 | 1 |
| 2 | T81 | 1 | 0 |
| 3 | T82 | • | • |
| • | • | • | • |
| • | • | • | • |

FORMAT EXAMPLE

PACKAGING AND PRICING DEVICE

BACKGROUND OF THE INVENTION

Field of the Invention

The present invention relates to a packaging and pricing device, and more specifically, it relates to a packaging and pricing device having a label issuing unit and an applicator for sticking two sheets of label on a surface of a packaged substance which is unloaded having been packaged with a film.

A substance to be packaged is loaded on an elevator and is lifted to the film supported in a stretched state on a packaging unit such that an upper surface of the substance to be packaged is covered with the film. And then, after left and right end portions and a rear end portion among end portions of the film are folded under a bottom surface of the substance to be packaged, the substance to be packaged is unloaded from the packaging unit. At this time, while a front end portion of the film is folded, the substance to be packaged is unloaded to a heat seal unit. In a case of sticking two sheets of label (a pricing label and a POP (Point of Purchase) label, or the like) to the packaged substance to be unloaded, in order to stick two sheets of label to positions designated by a user, a first label issued by a first label issuing unit is stuck to the packaged substance on the heat seal unit by controlling the applicator. Subsequently, a second label issued from a second label issuing unit is stuck to the packaged substance unloaded from the heat seal unit on an additional transfer conveyor connected to the heat seal unit.

That is, when two sheets are stuck to one packaged substance, at least two applicators are arranged to freely operate at different places where they do not interfere with each other (for example, see Patent Document 1).

For this reason, in order to make the place of the second label different from the sticking place (the heat seal unit) of the first label, the conventional packaging and pricing device needs the conveyor which transfers the packaged substance unloaded from the heat seal unit to another place. As a result, there is a problem in that an entire device is large-scaled and a cost is increased.

[Patent Document 1] Japanese Patent Laid-Open No. 2001-97544

The present invention has been made in consideration of the problem inherent in the prior art, and it is an object of the present invention to provide a packaging and pricing device which, in a case of sticking two sheets of label on a packaged substance, can freely move to stick labels while making applicators not interfere with each other at the same place.

In order to solve the above-mentioned problems, there is provided a packaging and pricing device for sticking labels to a packaged substance according to a first aspect of the present invention, in which a substance to be packaged is loaded on an elevator and lifted to a film by being supported on a packaging unit from its bottom, such that an upper surface of the substance to be packaged is covered with the film, and end portions of the film are folded under a bottom surface of the substance to be packaged. Here, the packaging and pricing device comprises label issuing units, arranged at both sides around the packaging unit, for issuing labels having different display contents, and applicators for sticking the labels issued from the label issuing units to predetermined position on the packaged substance respectively, the respective applicators performing the sticking operations so as not to interfere with each other.

More specifically, there is provided a packaging and pricing device for sticking labels to a packaged substance to be unloaded according to a second aspect of the present invention, in which a substance to be packaged is loaded on an elevator and lifted to a film by being supported on a packaging unit from its bottom, such that an upper surface of the substance to be packaged is covered with the film, left and right end portions and a rear end portion among end portions of the film are folded under a bottom surface of the substance to be packaged, a front end portion of the film is folded after the packaged substance is unloaded from the packaging unit, and the packaged substance is unloaded to a heat seal unit. Here, the packaging and pricing device comprises a first label issuing unit which is arranged on one side of an unloading path for unloading the packaged substance by pushing, a second label issuing unit which is arranged on the other side, a first applicator which receives a label from the first label issuing unit and which moves to one side in a widthwise direction of the unloaded packaged substance, thereby to stick the label on the packaged substance, and a second applicator which receives a label from the second label issuing unit and which moves to the other side in a widthwise direction of the unloaded packaged substance, thereby to stick the label on the packaged substance.

Each of the first label issuing unit and the second label issuing unit is not limited to one label issuing section, but it may have a plurality of label issuing sections. When the label issuing unit has the plurality of label issuing sections, the label issuing sections may be switched.

According to such a configuration, the first label issuing unit and the second label issuing unit are arranged with the unloading path, through which the packaged substance with the film is unloaded, interposed therebetween, and the labels issued by the respective label issuing units can be stuck to the sides of the packaged substance at the same position around the packaged substance (for example, the left and right sides in the widthwise direction of the packaged substance).

According to a third aspect of the present invention, the first applicator and the second applicator stick the labels to the packaged substance together at positions toward the heat seal unit.

According to such a configuration, the heat seal unit is positioned in the direction where the packaged substance is unloaded without changing the direction, and thus the left and right positions of the packaged substance are stable. Therefore, in a state in which the left and right positions of the packaged substance are stable, two sheets of label can be stuck thereto.

Further, according to a fourth aspect of the present invention, an unloading pusher unloads the packaged substance from the packaging unit, and the first applicator and the second applicator stick two labels to the packaged substance moved by the unloading pusher.

According to such a configuration, the packaged substance is pushed and supported by the unloading pusher, and thus the posture of the packaged substance is stable. Therefore, even when the timings of the sticking operations of the first applicator and the second applicator are different, the labels are stably and accurately stuck to the packaged substance.

In order to stick two sheets of label on one packaged substance, the substance to be packaged also has the width as that much. When the packaged substance does not have the width to an extent that two sheets of label are stuck to the packaged substance, only one label is stuck thereto.

Therefore, according to a fifth aspect of the present invention, when a width of the substance to be packaged is less then a predetermined value, the sticking operation by means of either the first applicator or and the second applicator is not performed.

According to such a configuration, when the width of the substance to be packaged is less than the predetermined value, the sticking operation of one of two applicators is not performed, such that the repetitive sticking of the labels or the collision between the applicators can be prevented. Further, even when the sticking operation of the applicator is not performed, the label is continuously issued, and thus the label can be stuck manually.

Further, according to a sixth aspect of the present invention, the movement of either the first applicator or the second applicator is controlled based on positional data set for the packaged substance and based on a position of the other applicator.

According to such a configuration, when one sheet of label is stuck to the packaged substance, the limitation of the sticking position is released, and thus the applicator can move to any position on the packaged substance to stick the label thereto.

Further, an operation which issues two labels and sticks two labels on one packaged substance may be automatically controlled based on product data of a product to be packaged.

Specifically, there is provided a packaging and pricing device for sticking labels on a packaged substance according to a seventh aspect of the present invention, in which a substance to be packaged (a product) is loaded on an elevator and lifted to a film by being supported on a packaging unit from its bottom, such that an upper surface of the substance to be packaged is covered with the film, and end portions of the film are folded under a bottom surface of the substance to be packaged, product data of the product being printed on the labels. Here, the packaging and pricing device comprises a storing means for storing a product information file which accommodates product data including at least a product number, a product name, and a unit price for each product, a calling means for calling target product data from the product information file stored in the storing means, a first label issuing unit arranged near the packaging unit, a second label issuing unit arrange near the packaging unit, a first applicator for absorbing a label issued from the first label issuing unit based on product data of the product which is selected by the calling means and for sticking the label on one half portion of an upper surface of the packaged substance, and a second applicator for absorbing a label issued from the second label issuing unit and for sticking the label on the other half portion of the upper surface of the packaged substance. Further, only when specified items are associated with product data selected by the calling means, the first applicator and the second applicator substantially simultaneously operate to respectively stick the label on the packaged substance.

As items set on the product information file, a PLU number, a product name and a unit price, a price, a barcode and an expiration date in a fixed-price product, an individual identification number indicating a technical product of a beef product, image data (POP data) or the like may be exemplified. However, the individual identification number is not limited to the beef product. For example, the individual identification number about a fowl meat product or a pork product which is expected to be introduced in future may be used.

Further, the specified items described herein means the individual identification number, POP data (image data), and so on. Here, when image data is one obtained by capturing a picture, a design, or the like with a scanner, it comes under the specified items.

Then, as a method of associating the specified items with product data, a method in which a head for the specified items (the individual identification number, image data or the like) is provided in product data and file data described later is linked with the head for the specified items or a method in which data is directly stored in the head for the specified items may be used.

Further, the applicator described herein means one having both functions as an absorbing unit for receiving the label issued with the label issuing unit and as a label sticking unit for moving and sticking the label absorbed and held by the absorbing unit on the predetermined position of the upper surface of the packaged substance.

According to the seventh aspect of the present invention, when the specified items are associated with selected product data, two labels are issued with the first label issuing unit and the second label issuing unit respectively and the first applicator and the second applicator substantially simultaneously operate to stick two labels respectively. That is, two sheets of label are substantially simultaneously stuck in a vicinity of the packaging unit, and thus the labels can be efficiently stuck with the applicators provided in the packaging and pricing device, with no manual operation. As a result, the entire device can be reduced in size.

According to an eighth aspect of the present invention, when the specified items are associated with selected product data, the specified items may be issued with the second label issuing unit and the product name and the unit price may be issued with the first label issuing unit, the specified items, the product name and the price being stuck on predetermined positions of the upper surface of the packaged substance. Further, according to a ninth aspect of the present invention, the specified items may be individual identification information indicating a technical product of the product or advertisement information.

According to such a configuration, a label with the specified items printed thereon other than the label on which at least the product name and the price are printed can be issued, and thus required information can be noticeably displayed.

Further, according to a tenth aspect of the present invention, the specified items are level format data of the label issued with the second label issuing unit.

According to such a configuration, for example, when the label on which predetermined items are printed in advance is issued with the second label issuing unit and the label is stuck by means of the second applicator, if only the format of the label issued with the second label issuing unit is set on product data, only by selecting the product, two labels can be automatically.

Further, there is provided a packaging and pricing device for sticking labels on a packaged substance according to an eleventh aspect of the present invention, in which a product is loaded on an elevator and lifted to a film by being supported on a packaging unit from its bottom, such that an upper surface of the product is covered with the film, and end portions of the film are folded under a bottom surface of the product. The packaging and pricing device comprises a storing means for storing a product information file which accommodates product data including at least a product number, a product name, and a unit price for each product, a calling means for calling target product data from the product information file stored in the storing means, a first label issuing unit arranged near the packaging unit, a second label issuing unit arrange near the packaging unit, a first applicator for absorbing a label issued from the first label issuing unit based on product data of the product which is selected by the calling means and for sticking the label on one half portion of an upper surface of the packaged substance, and a second applicator for absorbing a label issued from the second label issuing unit and for sticking the label on the other half portion of the upper surface of the packaged substance. Further, for each label format data set on product data, selection information of the first label issuing unit or the second label issuing unit is imparted.

According to such a configuration, for each label format data, selection information of the first label issuing unit or the second label issuing unit is imparted. Thus, the determined label format is surely issued with the determined label issuing unit and is stuck with the corresponding applicator. Therefore, even when the product is replaced, it is not needed to set the label issuing unit which issues the label.

[Advantages]

According to the configuration of the first or second aspect, the packaging and pricing device sticks two sheets of label to left and right sides the packaged substance separately, and thus the first and second applicators can move without interfering with each other. Therefore, two sheets of label can be stuck at the same place and, unlike the conventional packaging and pricing device, the transfer conveyor is not needed to make the sticking place of the second label different from the sticking place of the first label. As a result, an entire device can be reduced in size and a cost can be decreased.

Further, according to the configuration of the third aspect, in the state in which the left and right positions of the packaged substance just after packaging are stable, two sheets of label can be stuck. Further, when two sheets of label are stuck at those positions, the vertical and horizontal dimensions of the entire device can be not expanded, even if two label issuing units and two applicators are arranged.

In addition, according to the configuration of the fourth aspect, the packaged substance to be unloaded by pushing is stably supported by the pusher, and thus two sheets of label can be accurately stuck.

Further, according to the configuration of the fifth aspect, when the width of the substance to be packaged is less than the predetermined value, both the applicators do not perform the sticking operations, and thus the repetitive sticking of the labels or the collision between the applicators can be prevented. Further, since the label is issued even if the sticking operation of the applicator is not performed, a manual sticking operation is easily performed.

According to the configuration of the sixth aspect, when only one sheet of label is stuck to the packaged substance, the limit to the sticking place is released and the applicator moves to any position above the packaged substance, such that the label can be stuck at that position.

Further, according to the configuration of the seventh aspect, the specified items are associated with product data in advance, and thus, with the selection of the product, two labels are automatically stuck on the packaged substance by means of the first and second label issuing units and the first and second applicators provided in the packaging and pricing device. Then, the first and second applicators substantially simultaneously operate to stick two labels on the packaged substance, and thus the sticking operation can be efficiently performed. Therefore, the number of the packages per unit time can be increased.

As a result, a burden of a worker can be lightened when sticking the label, and the entire packaging and pricing device can be reduced in size.

Further, according to the configuration of the eighth aspect, the label with the specified items printed thereon other than the label on which at least the product name and the price are printed can be issued, and thus required information can be noticeably displayed.

Further, according to the configuration of the ninth or tenth aspect, it is not needed to set data exclusively used for determining a one-label sticking operation or a two-label sticking operation. Further, the one-label sticking operation or the two-label sticking operation can be judged by calling product data, and thus the sticking operation can be simplified.

Further, according to the configuration of the eleventh aspect, the label format is surely issued with the determined label issuing unit and is stuck on the packaged substance with the corresponding applicator. Therefore, even when the product is replaced, it is not needed to set the label issuing unit which issues the label. As a result, operationality can be enhanced.

SUMMARY OF THE INVENTION

4. Brief Description of the Drawings

FIG. 7 is a diagram illustrating a configuration of a product information file which is stored in a memory.

FIGS. 8A to 8D show various files which are stored in the memory, and specifically, FIG. 8A shows an individual identification number file, FIG. 8B shows an image file, FIG. 8C shows a label format file for a label issuing unit No. 1, and FIG. 8D shows a label format file for a label issuing unit No. 2.

FIG. 9A shows a label format file and FIG. 9B is a plan view showing an example of a printing format of a label.

DETAILED DESCRIPTION OF THE PREFERRED EMBODIMENTS

Hereinafter, an embodiment of a packaging and pricing device according to the present invention will be described with reference to the drawings.

Figure 1:
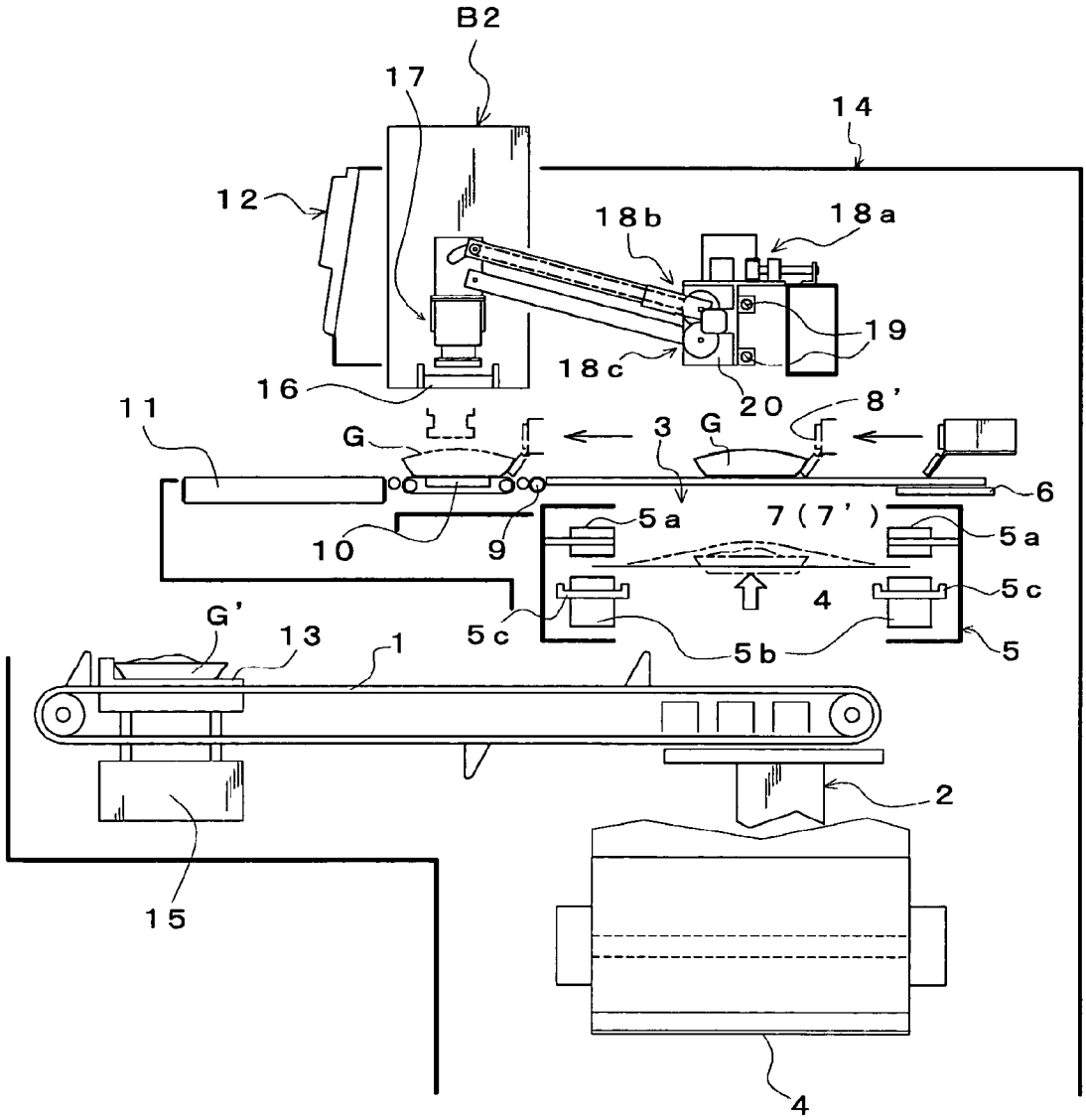
FIG. 1 is a longitudinal cross-sectional side view showing an outline of a packaging and pricing device according to the present invention.
Figure 2:
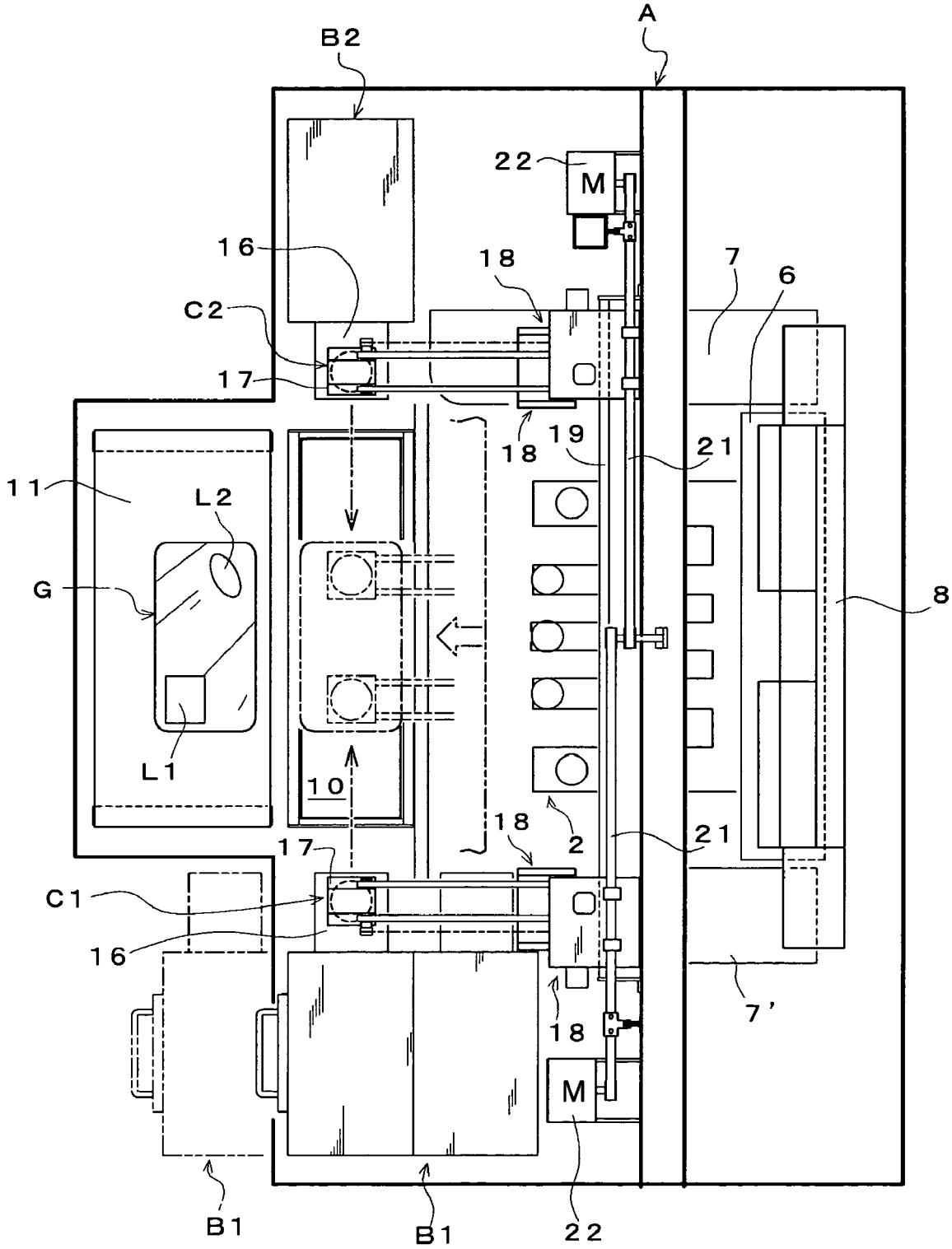
FIG. 2 is a plan view of a packing and pricing device shown in FIG. 1.

FIGS. 1 and 2 are schematic views showing an entire weighing, packaging and pricing device. Reference numeral A denotes a stretch film packaging machine, B1 denotes a first label issuing unit (a weighing label printer), B2 denotes a second label issuing unit (a weighing label printer), C1 denotes a first applicator (a label sticking device) which receives a label issued from the first label issuing unit B1 and sticks that to a packaged substance, and C2 denotes a second applicator (a label sticking device) receives a label issued from the second label issuing unit B2 and sticks that to the packaged substance. The first label issuing unit B1 and the second label issuing unit B2 are arranged to face each other on lateral upper portions of an unloading path of the packaged substance in the stretch film packaging machine A interposed therebetween. The first applicator C1 and the second applicator C2 are arranged above the unloading path.

The stretch film packaging machine A has a product loading unit 13, arranged in front of a machine casing 14, for loading an substance to be packaged (product) G' and transfers the substance to be packaged G' loaded on the product loading unit 13 up to an elevator 2 provided within the machine casing by a pusher conveyor 1. Moreover, in the present embodiment, a case in which the substance to be packaged G' is transferred while being housed in a tray serving as a container is exemplified. In addition, the product loading unit 13 serves as a weighing plate of the weighing unit 15.

Above the elevator 2, a packaging unit 3 is provided, and, in a direction lateral to the packaging unit 3 (a direction orthogonal to the pusher conveyor), a film roller 4 is set. A film 4' fed from the film roller 4 is led by a film feed mechanism 5 and is cut at a predetermined length. And then, the cut film is transferred up to the packaging unit 3.

In the packaging unit 3, a rear folding member 6 and left and right folding members 7 and 7' for folding the end portions of the film 4', which covers the upper surface of the substance to be packaged G', under the bottom of the product, an unloading pusher 8, disposed above the left and right folding members 7 and 7', for unloading the substance to be packaged (the packaged substance) after packaging, and a front folding roller 9 disposed ahead the unloading pusher 8 are arranged above the film feed mechanism 5.

The film feed mechanism 5 has a pair of upper and lower endless elastic belts 5*a* and 5*b* with widthwise side end portions of the film interposed therebetween and a clamp plate 5*c* for pressing the lower elastic belt 5*b* to the upper elastic belt 5*a* in contact. These are arranged with the packaging unit 3 interposed therebetween.

Further, in front of the front folding roller 9, a heat seal unit 10 for heating and adhering overlap portions of the end portions of the film folded toward the bottom of the substance to be packaged is arranged. Further, ahead the heat seal unit 10, an unloading means 11 is arranged. On the machine casing 14, a console unit 12 is arranged. Further, the first label issuing unit (a weighing label printer) B1 is arranged in an upper portion of one side (in the drawing, a right side) of the sides with the heat seal unit (the unloading path) 10 interposed therebetween. The second issuing unit (a weighing label printer) B2 is arranged in an upper portion of the other side (in the drawing, a left side). In addition, between the first and second label issuing units B1 and B2 and above the heat seal unit 10, the first applicator C1 and the second applicator C2 are arranged.

In the stretch film packaging machine A, the substance to be packaged G' carried on the elevator 2 is lifted to the film 4' supported in a stretched state on the packaging unit 3 when the elevator 2 is ascended. And the, the end portions of the film 4' which covers the upper surface of the substance to be packaged G' are folded under the bottom surface of the substance to be packaged by the rear folding member 6 and the left and right folding members 7 and 7'.

Next, while pushing the substance to be packaged G horizontally toward the heat seal unit 10 by means of the unloading pusher 8, the front end portion of the film 4' is folded under the bottom of the substance to be packaged by means of the front folding roller 9. And then, the overlap portions of the end portions folded under the bottom are heat-sealed by the heat seal unit 10, thereby obtaining the packaged substance G.

The first label issuing unit B1 prints predetermined items onto a label paper, where labels are removably stuck to a strip carrier sheet in a constant interval, by means of a printing unit having a thermal head and a platen roller. The printed label is removed from the carrier sheet by means of a dispenser and is discharged to a label holding unit 16. The carrier sheet is taken up around a carrier sheet taking-up axis. The first label issuing unit B1 has two known label printers arranged parallel to each other.

And then, one of two label printers issues a general pricing label regarding a price, a product name, a weight, a barcode, or the like. The other one prints and issues a POP pricing label. The operations of two label printers are set to be automatically switched according to the substance to be packaged. In the drawing, the first label issuing unit B1 issues a label L1.

Figure 4:
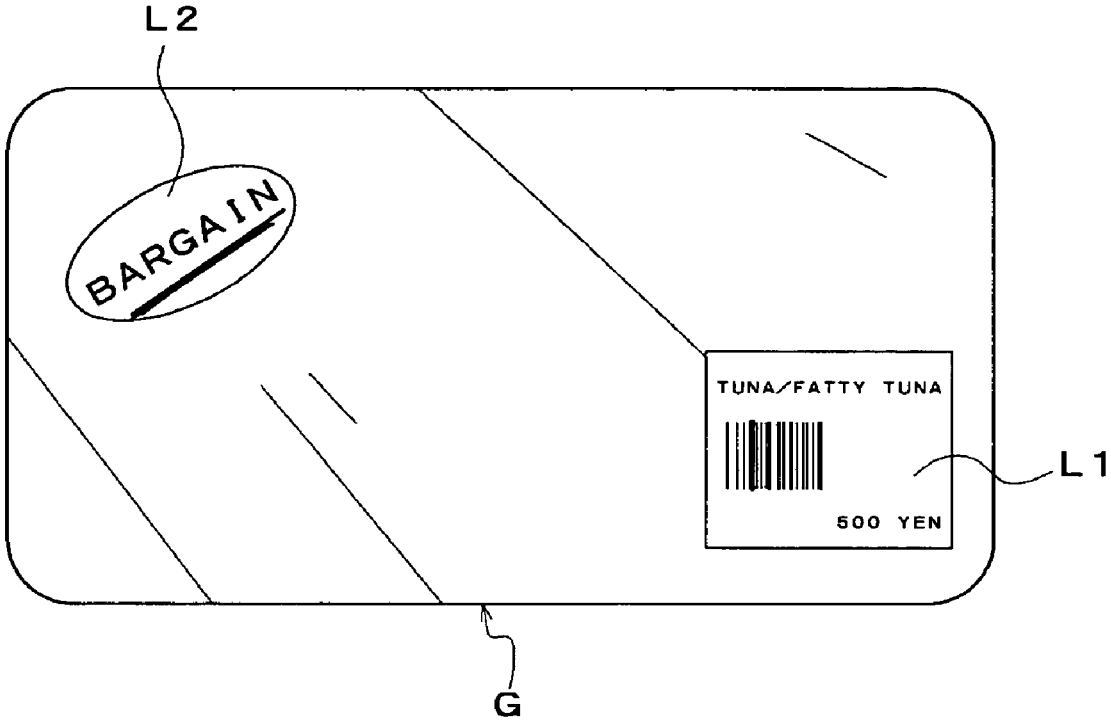
FIG. 4 is a plan view showing a state in which two sheets of label are stuck to a packaged substance.

Similarly to the first label issuing unit b1, the second label issuing unit B2 has a known label printer, and prints and issues special information not printed by the first label issuing unit B1, for example, information, other than product data, such as 'BARGAIN', 'SPECIAL PRICE' or the like. Therefore, a label used by the second label issuing unit B2 preferably has an unusual shape, which attracts public attention, such as an elliptical shape, a lozenge shape, or the like, as well as a general rectangular shape (see FIG. 4). In the drawing, the second label issuing unit B2 issues a label L2.

The first label issuing unit B1 and the second label issuing unit B2 constructed in such a manner are arranged at the sides with the heat seal unit 10 interposed therebetween such that the label holding units (label issuing ports) 16 are directed toward the first and second applicators C1 and C2 (inside the packaging machine), respectively.

The first applicator C1 which receives the label from the first label issuing unit B1 and automatically sticks it to the packaged substance G has a label absorption unit 17 for absorbing the label held in the label holding unit 16 of the first label issuing unit B1, a driving mechanism 18 for moving the absorption unit 17, and a control means (not shown) for controlling an operation of the driving mechanism 18. Further, similarly to the first applicator C1, the second applicator C2 which receives the label from the second label issuing unit B2 and automatically sticks it to the packaged substance G has a label absorption unit 17 for absorbing the label held in the label holding unit 16 of the second label issuing unit B2, a driving mechanism 18 for moving the absorption unit 17, and a control means (not shown) for controlling an operation of the driving mechanism 18. In addition, the driving mechanism 18 of the first applicator C1 and the driving mechanism 18 of the second applicator C2 are separated from each other at left and right sides to freely operate.

The label absorption unit 17 has a label absorption surface 17*a* for absorbing and holding the label and a suction box section 17*b*, arranged on an upper portion of the label absorption surface 17*a*, for causing a label absorption power in the label absorption surface 17*a*. When a fan 17*c* rotates, the pressure within the suction box section 17*b* becomes negative, thereby causing the absorption power in the label absorption surface 17*a*.

The driving mechanism 18 for moving the label absorption unit 17 has a first driving mechanism 18*a* for moving the label absorption unit 17 in a direction orthogonal to a direction in which the packaged substance G is carried, that is, in a widthwise direction of the heat seal unit 10, to which the packaged substance G is unloaded, the unloading means 11 connected to the heat seal unit 10, a second driving mechanism 18*b* for vertically moving the label absorption unit 17 with respect to a surface on which the packaged substance G is carried, and a third driving mechanism 18*c* for rotating the label absorption surface 17*a* of the label absorption unit 17 within a horizontal plane parallel to the surface on which the packaged substance G is carried.

The first driving mechanism 18*a* has two guide rods 19 fixed orthogonally to a pushing direction of the unloading pusher 8 in a horizontal manner above the packaging unit 3 of the packaging machine, a case 20 slidably engaged with the guide rods 19, endless belts 21 arranged in parallel along the guide rods 19, a stepping motor (a horizontal movement motor) 22 for moving and running the endless belts 21 forward and backward, and a pulley 23. The case 20 is connected and fixed to the endless belts 21, and the guide rods 19 are mounted to the machine casing 14 via a bracket. With the operation of the stepping motor 22, the case 20 moves along the guide rods 19.

Further, the label absorption unit 17 is mounted to front ends of a pair of upper and lower parallel arms 24 and 24' whose base ends are mounted to the case 20, which moves along the guide rods 19, as shown in FIG. 2. The pair of parallel arms 24 and 24' are supported such that the label absorption unit 17 moves vertically with respect to the packaged substance G by means of the second driving mechanism 18*b*.

As for the pair of parallel arms 24 and 24' for holding the label absorption unit 17, the base ends thereof are rotatably mounted to two pins 25 and 25' which are disposed vertically in a predetermined interval with respect to the case 20. The other end (front end) of the upper parallel arm 24 is connected to a pin 28 which is movably engaged with and racked on an arc groove 27 of a mounting cylinder 26 in a horizontal manner connected to an upper portion of the label absorption unit 17. The other end (front end) of the lower parallel arm 24' is mounted to a rotational axis 29 which is disposed below the pin 28 and is rotatably racked on the mounting cylinder 26. Therefore, the label absorption unit 17 freely pivots around the rotational axis 29 in the direction in which the packaged substance G is carried. The pivot range is regulated by means of the arc groove 27 (a swing mechanism). Further, the second driving mechanism 18*b* is mounted to the base end of the upper parallel arm 24 and the third driving mechanism 18*c* for rotating the label absorption surface of the label absorption unit 17 within the horizontal plane is mounted around the lower parallel arm 24'. In addition, when the label absorption unit 17 swings, an angle maintaining means for maintaining the label absorption unit 17 to an inclination angle of the shake is provided within the case 20.

As for the second driving mechanism 18*b*, a gear 30 is fixed to the pin 25 which supports the base end of the upper parallel arm 24. A gear 31 which rotates having been engaged with the gear 30 is fixed to a rotational axis of a motor (a vertical movement motor) 32 fixed to the upper surface of the case 20. In addition, supporting arms 33 are integrally fixed over both the side portions of the pin 25 projected outside from the case 20. The supporting arms 33 support the lower surface of the upper parallel arm 24 which is rotatably supported with respect to the pin 25.

As such, as for the second driving mechanism 18*b*, when the motor 32 rotates, the pin 25 rotates via the gear 31 and the gear 30, and then, with the rotation of the pin 25, the supporting arms 33 rotate vertically. Thus, the parallel arm 24 which is supported rotatably with respect to the pin 25 is supported by the supporting arms 33 from bottom and moves vertically in association with the vertical rotation of the supporting arms 33. Further, the parallel arm 24 freely rotates vertically around the pin 25 without contacting the supporting arms 33.

Figure 3:
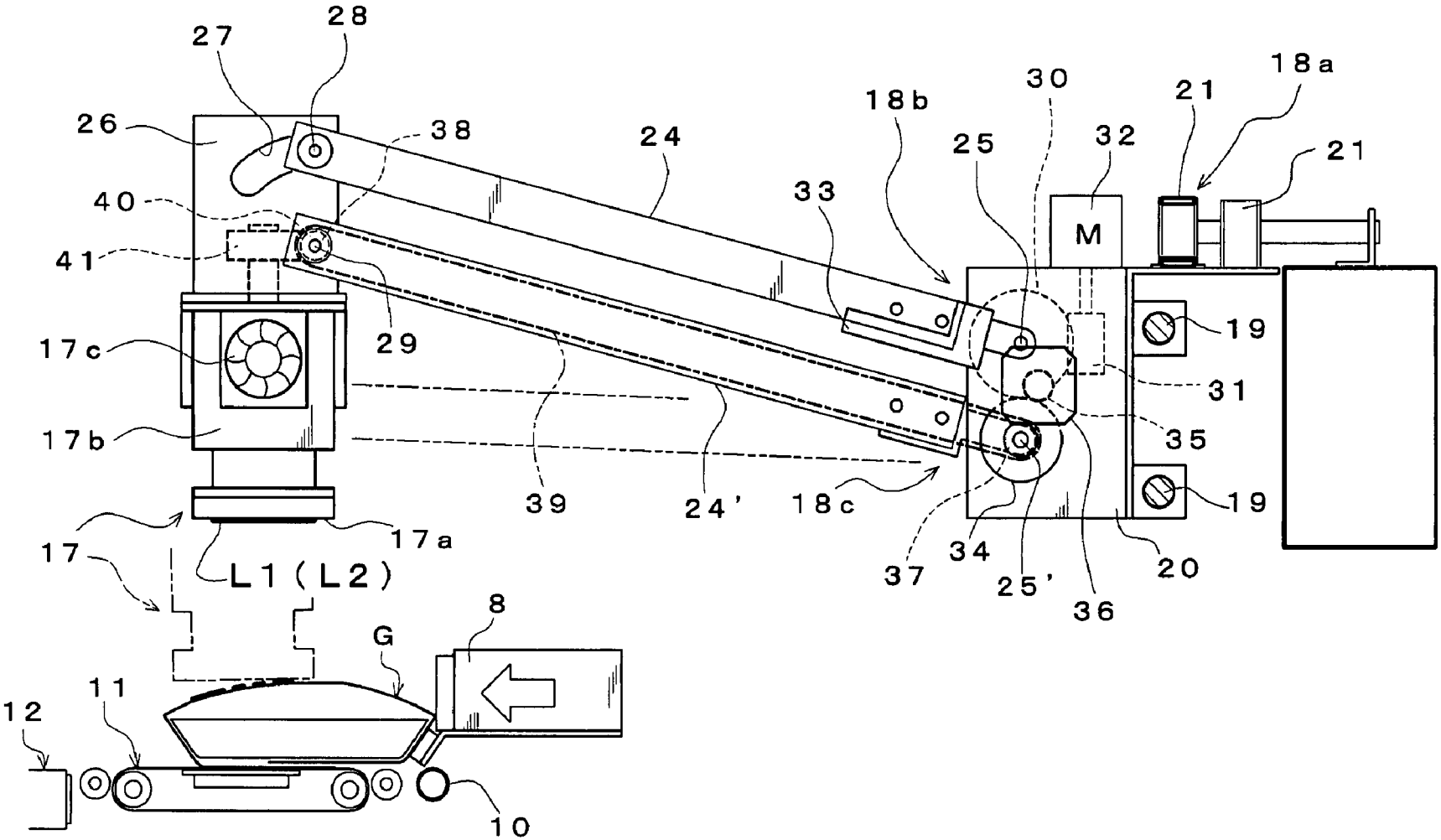
FIG. 3 is an expanded side view showing a label sticking device.

As for the third driving mechanism 18*c*, as shown in FIG. 3, a gear 34 is fixed to one end of the pin 25' which supports the base end of the lower parallel arm 24'. A gear 35 which rotates having been engaged with the gear 34 is fixed to a rotational axis of a motor (a horizontal rotation motor) 36 mounted to an outside of the case 20 via a bracket. To the other end of the pin 25', a sprocket 37 is fixed. Further, to one end of the rotational axis 29 which is rotatably racked on the mounting cylinder 26 fixed to the label absorption unit 17, a sprocket 38 is fixed. A toothed belt 39 is wound over the sprocket 38 and the sprocket 37. In addition, a gear 40 is fixed to an intermediate portion of the rotational axis 29 and a gear 41 which is engaged with the gear 40 is fixed to a supporting axis which supports the label absorption surface in an integrally rotational state. (In addition, as regards the details of the driving mechanism, see Japanese Patent Laid-Open No. 9-323720).

In the first applicator C1 and the second applicator C2, the driving mechanism 18 for moving the label absorption unit 17 is the same. Here, while the first applicator C1 sticks the label to a right half portion from a center in a widthwise direction of the packaged substance G which is unloaded by a pushing operation via the unloading path, the second applicator C2 sticks the label to a left half portion from a center in a widthwise direction of packaged substance G which is unloaded by a pushing operation via the unloading path. For this reason, the first driving mechanism 18*a* of the first applicator C1 and the first driving mechanism 18*a* of the second applicator C2 are separated from each other at both sides with respect to an approximately central position in a widthwise direction of the unloading path. Here, when both the applicators move around the approximately central portion of the unloading path, the interference may occur between them. In this case, however, the movement of each of the applicators is controlled not to exceed a limit value in a central direction stored in each of the applicators, such that both the applicators do not interfere with each other.

As such, there is no case in which, when sticking the labels, the first applicator C1 and the second applicator C2 interfere with each other.

As regards the timings at which the first applicator C1 and the second applicator C2 stick the labels, two timers start at the time when the unloading pusher 8 starts to push and reaches a predetermined position, and the sticking operations are started when a previously set time has passed. Further, the timings at which the first applicator C1 and the second applicator C2 stick the labels may be the same, such that the labels are stuck to the packaged substance G on the approximately same line of both sides of the packaged substance G. Alternatively, the time difference may be set, such that the positions where the left and right labels are stuck are deviated from each other before and behind (see FIG. 4).

In order to stick two sheets of label with the first applicator C1 and the second applicator C2, the packaged substance G is needed to have a width to an extent such that at least two sheets of label can be stuck thereto. When the width dimension is less than a predetermined width, only one of the first applicator C1 and the second applicator C2 operates and the other one does not operate.

For this reason, the width of the substance to be packaged G' should be detected. As a detection means, a reflection type optical sensor is arranged to move in a widthwise direction near the product loading unit 13 on which the substance to be packaged (product) G' is loaded and the width dimension of the substance to be packaged on the product loading unit 13 is measured by moving the sensor (for details, see Japanese Patent No. 2770774), a method in which width data of the substance to be packaged is input in advance to product data and called later for use, or the like may be used.

Further, the movement of one of the first applicator C1 and the second applicator C2 is controlled based on positional data on the packaged substance regarding the label sticking set in advance and a position of the other applicator. For example, when only one label is stuck to the packaged substance G, only one of the first applicator C1 and the second applicator C2 operates. Thus, the operable applicator can move to a free position on the packaged substance G, thereby sticking the label at that position.

Figure 5:
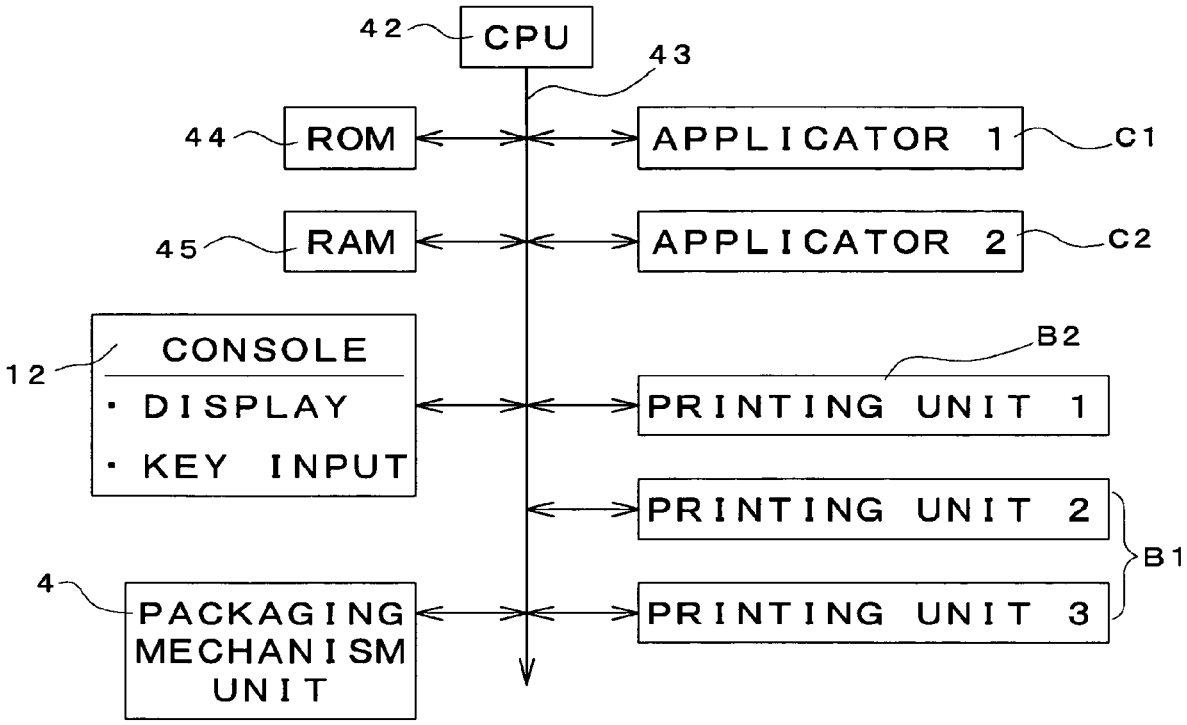
FIG. 5 is a block diagram showing an electrical configuration of a control means.

FIG. 5 is a block diagram showing an electrical configuration of the above-mentioned device. The control unit and the label issuing unit of the packaging machine and the control unit of the applicator are electrically connected to each other. In the packaging machine, the controls of various operations are performed by a micro computer. In the drawing, reference numeral 42 denotes a CPU (Central Processing Unit) having a micro computer, to which a ROM 44, a RAM 45, the console unit 12, a packaging mechanism unit 47, the first applicator C1, the second applicator C2, the first label issuing unit (printing units 2 and 3) B1, and the second label issuing unit (a printing unit 1) B2 are connected.

The ROM 44 stores a control program which is executed by the CPU 42. The RAM 45 is provided with a preset data area in which all kinds of data are stored for each substance to be packaged, in addition to areas for various registers and flags which are used when the CPU 42 executes the control program of the ROM 44. In the preset data area, for the substance to be packaged G', 'a product name', 'a unit price', a designation of the label issuing unit, the label sticking position or the like, as data for a price calculation and a label printing, and various tables for determining control data based on dimensional data of the substance to be packaged are stored.

The console unit 46 has an operating unit comprising a keyboard and a touch panel and a display unit comprising a liquid crystal display and displays input data, preset data, and various messages based on all kinds of data, an input of an instruction, or instructions from the CPU 42.

The packaging mechanism unit 47 is a circuit for driving respective mechanism units of the stretch film packaging machine when packaging. Specifically, a motor for driving the elevator 2, a motor of a conveyor for carrying-in the substance to be packaged, a motor of a film carrying mechanism, and a motor for moving the folding members which folds the end portions of the film may be included.

Figure 6:
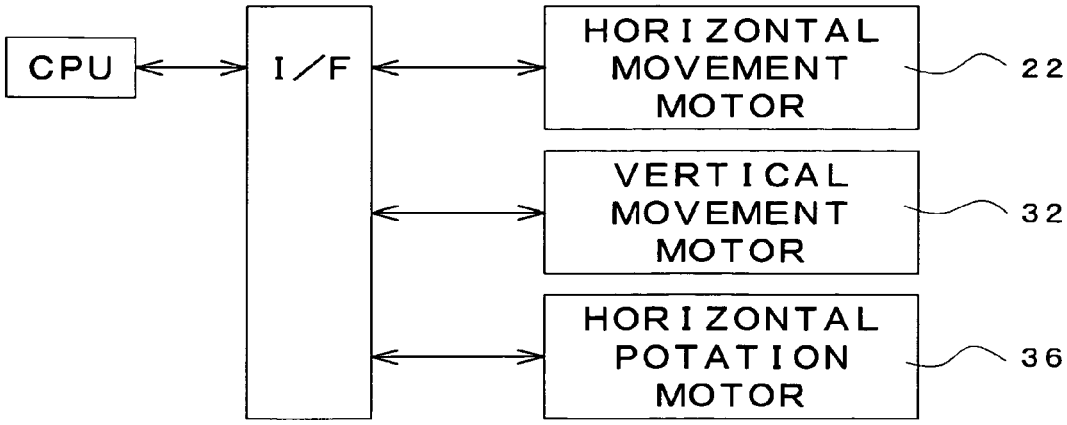
FIG. 6 is a block diagram showing a driving configuration of an applicator.

The first applicator C1 and the second applicator C2 have the configuration shown in FIG. 6 respectively. Accordingly, the applicators can operate separately from each other.

The first label issuing unit B1 (in FIG. 2, arranged at the right side of the unloading path) has two label printers of a printing unit 2 for printing and issuing the general pricing label and a printing unit 3 for printing and issuing the POP pricing label. The printing unit 2 and the printing unit 3 can be automatically switched by means of settings.

The second label issuing unit B2 (in FIG. 2, arranged at left side of the unloading path) prints and issues the special label (for example, 'BARGAIN', 'SPECIAL PRICE', or the like).

A product information file stores product data and a specified item associated with product data for each product. For example, as shown in FIG. 7, items such as 'PLU NUMBER', 'PRODUCT NAME', 'UNIT PRICE', 'BARCODE', 'EXPIRATION DATE', 'INDIVIDUAL IDENTIFICATION NUMBER', 'IMAGE DATA', 'LABEL ISSUING UNIT No. 1' (the first label issuing unit), 'LABEL ISSUING UNIT No. 2' (the second label issuing unit), and 'INTERLOCK/NONINTERLOCK' are set on the product information file.

'INDIVIDUAL IDENTIFICATION NUMBER' is generally the number indicating a technical product of a beef product, but it may be used for a fowl meat product or a pork product which is expected to be introduced in future. Moreover, the individual identification number may be stored in a corresponding file by inputting the number based on the meat received with a numeric key or by reading a barcode printed on the meat received with a scanner.

'IMAGE DATA' includes POP data described with large characters such as "BARGAIN", "SALE" or the like, or image data (for example, BMP file format) obtained by capturing a picture or a design with a scanner and is stored in an image data file shown in FIG. 8B. Then, among a group of image data stored in the image data file, desired data is selected and stored for each product.

Label format files of 'LABEL ISSUING UNIT No. 1' and 'LABEL ISSUING UNIT No. 2' set and store formats of labels which the respective applicators stick. The label format defines layouts (see FIG. 9B) of respective printing items on the label, in addition to the size of the label, as one used for a general label printer or the like. Based on the layouts, the respective printing items are printed with the first label issuing unit B1 or the second label issuing unit B2.

Then, the respective items of 'INDIVIDUAL IDENTIFICATION NUMBER', 'IMAGE DATA', 'LABEL ISSUING UNIT No. 1', 'LABEL ISSUING UNIT No. 2', 'INTERLOCK/NONINTERLOCK' correspond to specified items D. Depending on which of the specified items is stored and set in association with product data, the driving of the first applicator C1 or the second applicator C2 is controlled. For example, if image data is set on the selected product and the label format including the layout of image data is set on the label issuing unit No. 2, image data is issued with the second label issuing unit and the price label is issued with the first label issuing unit. Then, two labels are stuck on the upper surface of the packaged substance G in a vicinity of the packaging unit by means of the first and second applicators respectively.

Moreover, 'INDIVIDUAL IDENTIFICATION NUMBER' or 'IMAGE DATA' of the specified items D is printed in the label format of the applicator No. 2. The price label such as 'PRODUCT NAME', 'UNIT PRICE', 'PRICE (the value obtained by multiplying the unit price by a weight)', 'BARCODE', or the like is printed with the applicator No. 1.

Further, the label formats of the individual identification number' and image data of the specified items D may be set to predetermined fixed formats respectively. In this case, if only data of the individual identification number or image data is set, it is not needed to additionally select format data from the label format file (see FIG. 8D) for the label issuing unit No. 2. That is, if only data of the individual identification number or image data is set on product data of the selected product, a predetermined label is issued from the label issuing unit No. 2 and then it is stuck on the upper surface of the packaged substance by means of the corresponding applicator, together with the price label.

Further, the second applicator C2 receives and sticks the label on which predetermined items are printed by the second label issuing unit B2. Alternately, the second applicator C2 may receives a label on which the predetermined items are printed in advance from the second label issuing unit B2 and sticks it.

In this case, only the label format of the label issuing unit No. 2 is set on selected product data. Then, the label format (the size of the label or the interval of labels stuck on the carrier sheet) of the label issuing unit No. 2 comes under the specified items D.

Figure 10:
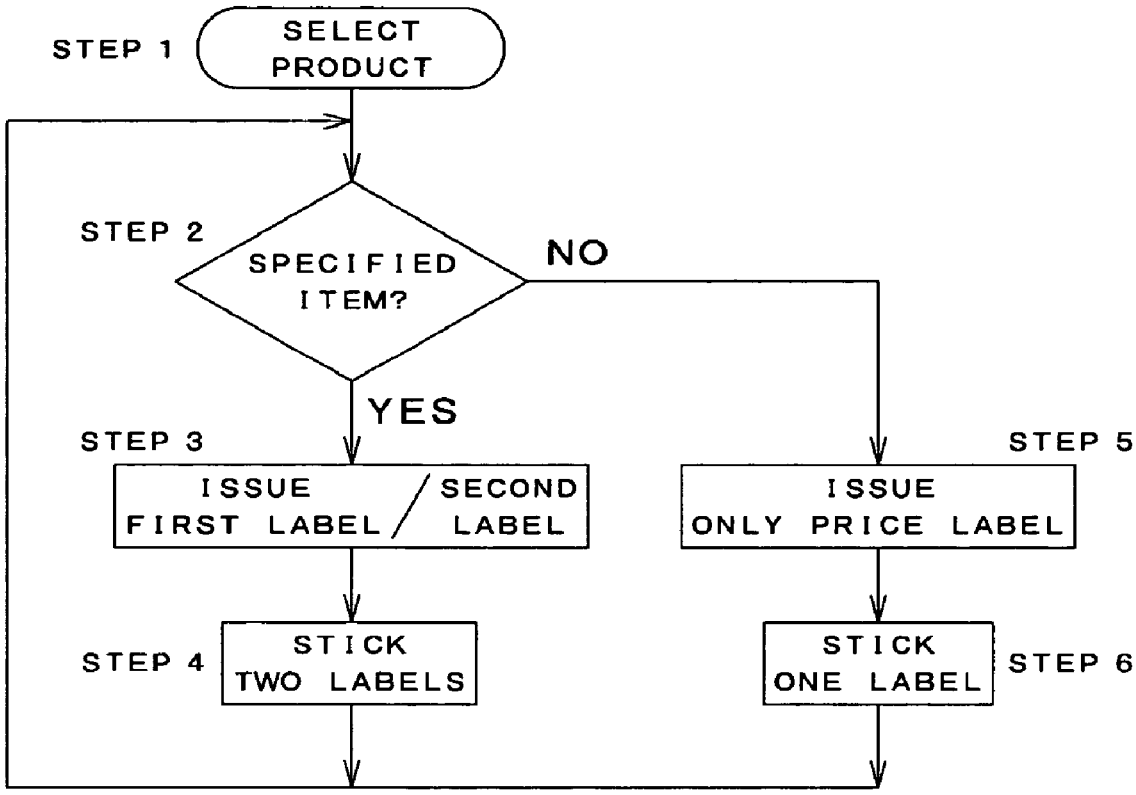
FIG. 10 is a flowchart of a label sticking operation.

Then, if the individual identification number and image data is set on product data selected from the product information file or predetermined data is set on the label issuing unit No. 2, as shown in a label sticking flow of FIG. 10, substantially simultaneously with the first applicator C1 which sticks the price label issued from the first label issuing unit B1, the second applicator C2 sticks the label issued from the label issuing unit No. 2, such that two sheets of label are stuck on the upper surface of the packaged substance.

Hereinafter, the label sticking flow of FIG. 10 will be described.

(Step 1) . . . An operating unit of a console unit (a calling means) is operated to select target product data from the product information file.

(Step 2) . . . It is determined whether or not the specified items (the individual identification number, image data, or the like) are associated with selected product data or whether or not predetermined data is set on the label issuing unit No. 2.

(Step 3) . . . When the specified items are associated with selected product data, the price label is issued with the first label issuing unit B1 and the POP label and so on are issued with the second label issuing unit B2.

(Step 4) . . . The price label issued with the first label issuing unit B1 and the POP label and so on issued with the second label issuing unit B2 are stuck on the predetermined positions of the upper surface of the package substance by means of the first applicator C1 and the second applicator C2 respectively.

(Step 5) . . . When the specified items are not associated with product data, the price label is issued with the first label issuing unit B1.

(Step 6) . . . The price label is stuck on the predetermined position of the upper surface of the packaged substance with the corresponding first applicator C1.

In order to increase reliability of the two-label sticking operation, interlock/noninterlock flags regarding the operations of the first applicator C1 and the second applicator C2 may be additionally provided. That is, even when data coming under the price label, such as the product name and so on, which is stuck with the first applicator C1 and the individual identification number, image data, and so on coming under the specified items D which are stuck with the second applicator C2, if the interlock flag is not selected, the first applicator C1 and the second applicator C2 may be not substantially simultaneously driven. In this case, an interlock/noninterlock item comes under the specified items D.

Moreover, the change between interlock and noninterlock states is performed by a display unit and an operation unit in the console unit 12, and thus the corresponding flag of the product information file can be changed.

Figures 9A, 9B:
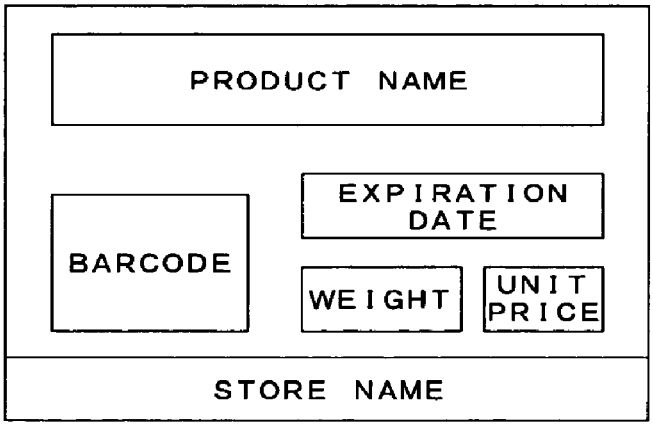
FIGS. 9A and 9B show other files which are stored in the memory, and specifically.

Further, in addition to the above-mentioned label formats (see FIGS. 8C and 8D) of the label issuing unit No. 1 and the label issuing unit No. 2, as shown in FIG. 9A, information regarding which of the label issuing unit No. 1 or the label issuing unit No. 2 is used for each label format may be set and stored.

Accordingly, for example, when the label issuing unit No. 2 is set with respect to the label format of the label on which the predetermined item such as "SPECIAL PRICE" or the like is printed with the POP characters in advance, the label may be issued with the label issuing unit No. 2 and may be stuck on the left side of the packaged substance with the corresponding second applicator C2.

That is, when the corresponding label is set on the second label issuing unit B2 and only the label format (the label interval on the carrier sheet, the size of each label represented by the longitudinal width and the traverse width, or the like) is set, the label can be stuck accordingly.

The present invention is not limited to the above-mentioned embodiment, but various modifications can be achieved within the scope without departing from the subject matter of the present invention.

(1) The mechanism of the packaging device is not limited to the type described in the above-mentioned embodiment. In the above-mentioned embodiment, the product packaged by the packaging unit is unloaded outside the packaging device by the unloading pusher. Alternatively, the product may be loaded on an elevator and lifted to the film by being supported on the packaging unit, such that the upper surface of the product may be covered with the film, and the end portions of the film may be folded under the bottom surface of the product with omni-directional plates, without using the unloading pusher. Then, at the position where the product is packaged, the labels issued by the label issuing units Nos. 1 and 2 may be stuck by the applicators respectively.

(2) The arrangement positions of the label issuing units Nos. 1 and 2, the first applicator C1, and the second applicator C2 are not limited to the embodiment. For example, the applicators corresponding to the respective label issuing units may be integrally configured in a tandem relationship to the label issuing units such that the issued labels may be positioned on the absorbing units of lower portions of the applicators. The label issuing units and the applicators configured integrally may be positioned above the packaging unit.

(3) In the embodiment shown in the drawings, the price label issuing unit is positioned at the right side to the packaging unit and the label issuing unit printing the specified items D is positioned at the left side thereto. Alternatively, the positions of both issuing units may be inverted.

The present invention is not limited to the above-mentioned embodiment, but various modifications can be achieved within the scope without departing from the subject matter of the present invention.

(1) A scheme for moving the packaged substance, which is packaged with the film, toward the unloading means is not limited to the pusher shown in the drawing. For example, a conveyor may be used for the packaged substance.

(2) The label printer constituting the label issuing unit is not limited to the weighing type. For example, a fixed amount type label printer may be used or a label printer which issues a previously printed label without having the printing function may be used.

(3) The second label issuing unit B2 may print and issue the label based on printing information which can not be printed onto the label of the first label issuing unit B1 and may stick it to the packaged substance G. Alternatively, the second label issuing unit may be used to print additive information of different printing amount for each product.

(4) When product data is called, the label may be not issued from the second label issuing unit, and thus the movement of the first applicator may be controlled without considering the movement limit value.

(5) The position at which the label is stuck may be near the heat seal unit.

What is claimed is:

1. A packaging and pricing device for sticking labels on a packaged substance, in which a substance to be packaged is loaded on an elevator and lifted to a film by being supported on a packaging unit from its bottom, such that an upper surface of the substance to be packaged is covered with the film, and end portions of the film are folded under a bottom surface of the substance to be packaged, the packaging and pricing device comprising:

a first label issuing unit and a second label issuing unit, arranged at both sides around the packaging unit, for issuing labels having different display contents; and a first applicator and a second applicator for sticking the labels issued from the first labeling issuing unit and the second label issuing unit to a predetermined position on the packaged substance respectively, said first applicator having a first driving mechanism configured to move the first applicator horizontally between the first label issuing unit and a first sticking position of the packaged substance, said second applicator having a second driving mechanism configured to move the second applicator horizontally between the second label issuing unit and a second sticking position of the packaged substance, wherein said first applicator and said second applicator perform the sticking operations so as not to interfere with each other, said first and second driving mechanisms being configured to move said first and second applicators independently of corresponding first and second label issuing units.

2. The packaging and pricing device according to claim 1, wherein the first applicator and the second applicator stick the labels to the packaged substance together at positions proximate a heat seal unit.

3. The packaging and pricing device according to claim 1, wherein an unloading pusher unloads the packaged substance from the packaging unit, and the first applicator and the second applicator stick two labels to the packaged substance moved by the unloading pusher.

4. The packaging and pricing device according to claim 1, wherein, when a width of the packaged substance is less then a predetermined value, the sticking operation of either one of the first applicator or the second applicator is prevented.

5. The packaging and pricing device according to claim 1, wherein the movement of either the first applicator or second applicator is controlled based on positional data set for the packaged substance and based on a position of the other applicator.

6. A packaging and pricing device for sticking labels on a packaged substance to be unloaded, in which a substance to be packaged is loaded on an elevator and lifted to a film by being supported on a packaging unit from its bottom, such that an upper surface of the substance to be packaged is covered with the film, left and right end portions and a rear end portion among end portions of the film are folded under a bottom surface of the substance to be packaged, a front end portion of the film is folded after the packaged substance is unloaded from the packaging unit, and the packaged substance is unloaded to a heat seal unit, the packaging and pricing device comprising:

a first label issuing unit which is arranged on one side of an unloading path for unloading the packaged substance by a pushing operation, a second label issuing unit which is arranged on the other side of the unloading path, a first applicator which receives a label from the first label issuing unit and which moves to one side in a widthwise direction of the unloaded packaged substance, thereby to stick the label on the packaged substance, and a second applicator which receives a label from the second label issuing unit and which moves to the other side of the widthwise direction of the unloaded packaged substance, thereby to stick the label on the packaged substance, wherein said first applicator has a first driving mechanism configured to move said first applicator between said first labeling issuing unit and a first sticking position, and said second applicator has a second driving mechanism configured to move said second applicator between said second label issuing unit and a second sticking position, said first and second driving mechanisms being configured to move said first and second applicators independently of corresponding first and second label issuing units.

* * * * *